US007631688B2

(12) United States Patent
Brost et al.

(10) Patent No.: US 7,631,688 B2
(45) Date of Patent: Dec. 15, 2009

(54) FLAT TUBE HEAT EXCHANGER WITH HOUSING

(75) Inventors: Viktor Brost, Aichtal (DE); Thomas Eckert, Neuweiler (DE); Denis Bazika, Esslingen (DE)

(73) Assignee: Modine Manufacturing Company, Racine, WI (US)

( * ) Notice: Subject to any disclaimer, the term of this patent is extended or adjusted under 35 U.S.C. 154(b) by 439 days.

(21) Appl. No.: 11/272,204

(22) Filed: Nov. 10, 2005

(65) Prior Publication Data

US 2006/0096747 A1 May 11, 2006

(30) Foreign Application Priority Data

Nov. 10, 2004 (EP) ..... 04026647

(51) Int. Cl.
*F28F 3/00* (2006.01)
*F28F 9/02* (2006.01)
*F28D 7/10* (2006.01)

(52) U.S. Cl. ..... 165/166; 165/157; 165/158

(58) Field of Classification Search ..... 165/157, 165/158, 166

See application file for complete search history.

(56) References Cited

U.S. PATENT DOCUMENTS

| | | | | |
|---|---|---|---|---|
| 4,183,402 | A * | 1/1980 | Cotter | 165/175 |
| 4,384,611 | A * | 5/1983 | Fung | 165/166 |
| 4,688,631 | A * | 8/1987 | Peze et al. | 165/166 |
| 4,852,643 | A * | 8/1989 | Mihailov | 165/113 |
| 5,069,276 | A * | 12/1991 | Seidel | 165/166 |
| 5,469,914 | A * | 11/1995 | Davison et al. | 165/166 |
| 5,487,424 | A * | 1/1996 | Davison | 165/166 |
| 6,250,380 | B1 | 6/2001 | Strahle et al. | |
| 6,920,918 | B2 * | 7/2005 | Knecht et al. | 165/157 |
| 7,077,190 | B2 | 7/2006 | Hayashi et al. | |
| 7,243,707 | B2 * | 7/2007 | Brost et al. | 165/103 |
| 7,571,718 | B2 | 8/2009 | Hendrix et al. | |
| 2006/0032613 | A1 * | 2/2006 | Brost et al. | 165/103 |
| 2006/0048926 | A1 | 3/2006 | Richter | |

FOREIGN PATENT DOCUMENTS

| | | | |
|---|---|---|---|
| DE | 19927607 | | 12/2000 |
| DE | 20118511 | | 2/2002 |
| EP | 1376043 | | 1/2004 |
| EP | 04 019 339.3 | | 8/2004 |
| GB | 2218195 | | 11/1989 |
| JP | 11303689 | A * | 11/1999 |
| JP | 2000055585 | A * | 2/2000 |

OTHER PUBLICATIONS

EP04026647 European Search Report, 1 page, dated May 23, 2005.

* cited by examiner

*Primary Examiner*—Cheryl J Tyler
*Assistant Examiner*—Brandon M Rosati
(74) *Attorney, Agent, or Firm*—Michael Best & Friedrich LLP

(57) ABSTRACT

A heat exchanger including a stack of flat tubes for gas and a housing for the stack of flat tubes, with the housing enclosing only part of the periphery of the flat tube stack. The tubes have wide and narrow sides and are spaced to form channels therebetween for flow of a coolant. Cross-sectional widenings along the length of the tubes assist in maintaining the flat tubes in a spaced condition along the periphery not enclosed by the housing, and close the channels along the tube stack periphery not enclosed by the housing.

16 Claims, 9 Drawing Sheets

FLAT TUBE HEAT EXCHANGER WITH HOUSING

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward heat exchangers, and particularly toward heat exchangers having flat tubes and a housing.

BACKGROUND OF THE INVENTION AND TECHNICAL PROBLEMS POSED BY THE PRIOR ART

Heat exchangers are, of course, well known in the art and have been used in a wide variety of applications.

One type of heat exchanger, described in European Patent Appl. No. EP 04 019 339.3 (corresponding to U.S. Ser. No. 11/201,783, filed Aug. 11, 2005), is illustrated in FIG. 1, and concerns an exhaust heat exchanger with a bypass 86'. A housing 30' encompasses the entire periphery of the stack of flat tubes 10', as is clear by glancing at the figures, with channels 26' formed by insert parts. The present invention is an improvement upon this heat exchanger, with a simplified design in which a bypass may be included or not. Other components of the FIG. 1 heat exchanger not described here are identified by reference numerals which correspond to reference numbers used to identify generally corresponding components of the below described heat exchangers incorporating the present invention, but with prime ("") added to the reference numerals in FIG. 1.

SUMMARY OF THE INVENTION

According to the present invention, a heat exchanger is provided, including a stack of flat tubes for gas and a housing for the stack of flat tubes, with the housing enclosing only part of the periphery of the flat tube stack. The tubes have wide and narrow sides and are spaced to form channels therebetween for flow of a coolant, and means are provided for maintaining the flat tubes in a spaced condition along the periphery not enclosed by the housing, where those means additionally close the channels along the tube stack periphery not enclosed by the housing.

In one form of the invention, the housing is spaced on all sides relative to the periphery of the tube stack to define a channel between the inside of the housing and the stack.

In another form of the invention, the housing is U-shaped with arms extending in the direction of the wide sides of the flat tubes, and the housing arms are joined to the wide sides of the outermost flat tubes.

In still another form of the invention, a cross-sectional widening extends in the longitudinal direction of the flat tubes, wherein the housing is U-shaped with arms connected to the wide sides of the flat tubes. In a further form, the cross-sectional widening is provided in at least one of the wide sides of the flat tubes and extends in a strip over the entire length of flat tubes. In another form, the housing arms have an offset connection edge connected to the cross-sectional widening and, in a further form, the housing connection edge has beads receiving the corresponding section of connection edges of the tubes. In still another further form, the flat tubes are stacked with their cross-sectional widening abutting each other and, in further forms, the tubes are formed of plates and the channels are formed by deformation of the plates, or the tubes are formed of one piece with a welded longitudinal seam in one of the two narrow sides and the cross-sectional widening is made from a sheet strip during flat tube production.

In yet another form of the invention, receiving beads are on two sides of the connection edge of the collecting tanks.

In still another form of the invention, internal inserts are in the flat tubes and, in a further form, the internal insert is a corrugated sheet in which corrugations form discrete flow passages for the gas.

In yet another form of the invention, an inlet collecting tank and an outlet collecting tank are provided for the gas. In a further form, a bypass within the flat tubes is defined by the internal inserts and a partition in at least one of the inlet and outlet collecting tanks and, in a still further form, at least the flow passage of the internal insert adjacent to the bypass is essentially not traversed by gas so that heat transfer to the bypass is suppressed.

DETAILED DESCRIPTION OF THE INVENTION

Heat exchangers incorporating the present invention are shown in the Figures.

In the depicted practical examples, only three or four flat tubes 10 are stacked one on the other and each is provided with a collecting tank 14, 16 (see FIGS. 6-7 and 21-22) on the ends of the heat exchanger. The number of flat tubes 10 is arbitrary, guided according to the requirements of the individual application. Further, while the practical examples depicted in the Figures refer to exhaust heat exchangers cooled with the coolant of the internal combustion engine for a vehicle, which may be incorporated in a known manner (not shown) in an exhaust gas recirculation system, no restriction as to the invention is to be implied by this.

In the practical examples according to FIGS. 2-14, one-piece flat tubes 10 may advantageously be solderable stainless-steel sheet and, in the case of a heat exchanger for charge air, for example, aluminum sheet may be advantageously used. The flat tubes 10 may be advantageously produced from endless metal sheet strip in which a longitudinal welding seam 17 is preferably provided in one of the narrow sides 18.

Figure 8:
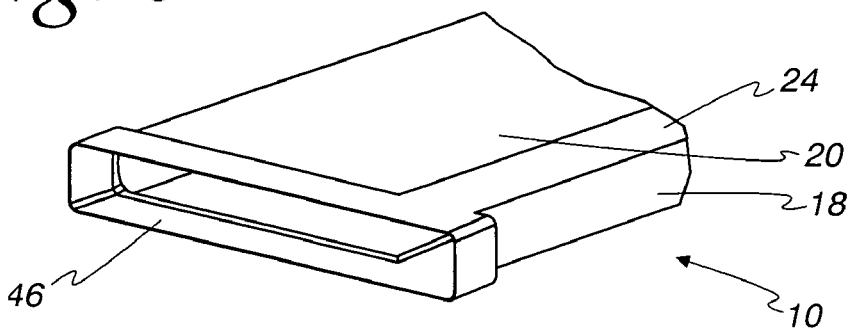
FIG. 8 is a perspective view of a flat tube which may be used with the present invention.
Figure 9:
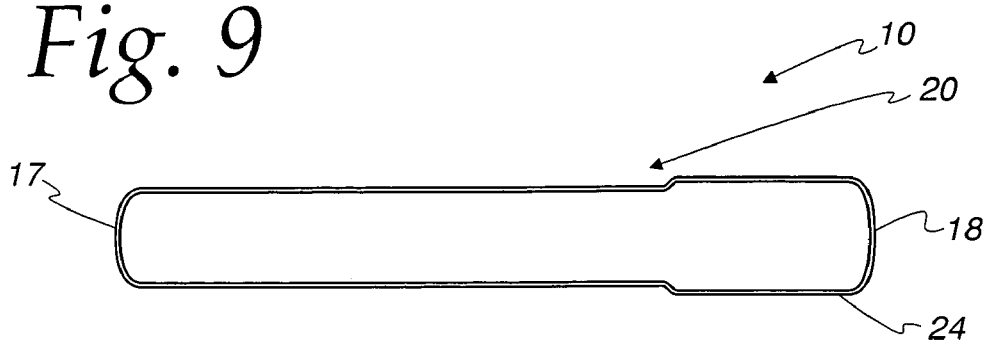
FIG. 9 is a cross-section of a one-piece flat tube which may be used with the present invention.
Figure 10:
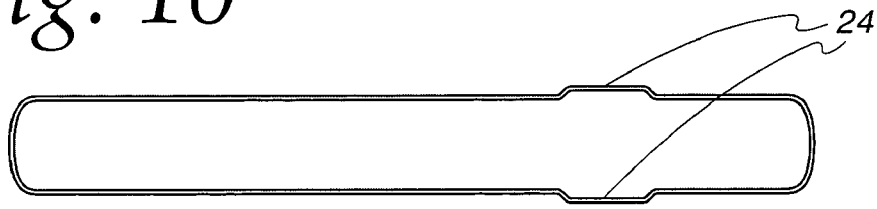
FIG. 10 is a cross-section of another one-piece flat tube which may be used with the present invention.
Figure 23:
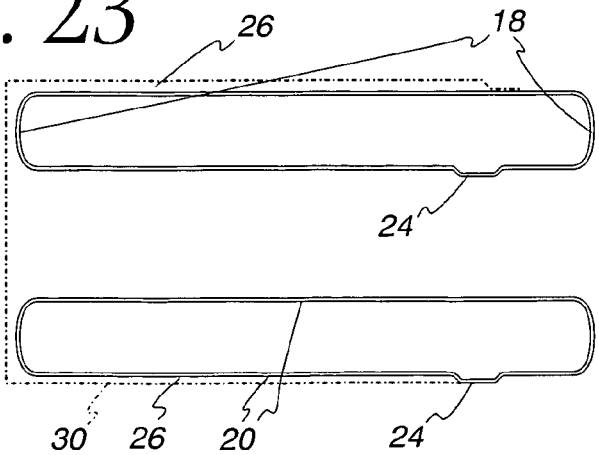
FIG. 23 is a simplified end view of a tube stack wherein the flat tubes have a cross-sectional widening only on one wide side.

In both wide sides 20 of each flat tube 10 (see, e.g., FIGS. 9-10), a cross-sectional widening 24 is formed, which extends over the entire length of flat tube 10. Two different configurations of such flat tubes 10 are shown in FIGS. 9 and 10. According to FIG. 9, the cross-sectional widening 24 is relatively wide and extends to the narrow side 18 (the narrow side 18 lying to the right in FIG. 9). Part of this flat tube 10 is also shown in FIG. 8 in a perspective view. Alternatively, the flat tubes 10 as shown in to FIG. 10 have a cross-sectional widening 24 that does not reach the narrow side 18, with the cross-sectional widening 24 being a continuous longitudinal strip which is narrower than that of FIG. 9. It is also possible, in principle, to make the cross-sectional widening 24 in only one of the wide sides 20 of flat tubes 10 and to form a stack from such flat tubes 10, as illustrated by the two flat tubes 10 in FIG. 23.

It should be appreciated that the height of the channel 26 between the flat tubes 10 can naturally be determined by the height of the gradation 24 (cross-sectional widening). It should also be understood, however, that while arranging an additional part between the flat tubes 10 may be used to form the channels instead of the cross-sectional widening 24 is feasible, but in the most preferred form of this invention the cross-sectional widening is used for this function. Further, the connection edge 28 of the housing 30 (illustrated by a dash-dot line in FIG. 23) can be offset somewhat more strongly in order to obtain the desired width of the outer channel 26. However, it should be appreciated that, in some applications, an outer channel 26 may be advantageously omitted so that offset of the connection edge 28 is not necessary.

Figure 5:
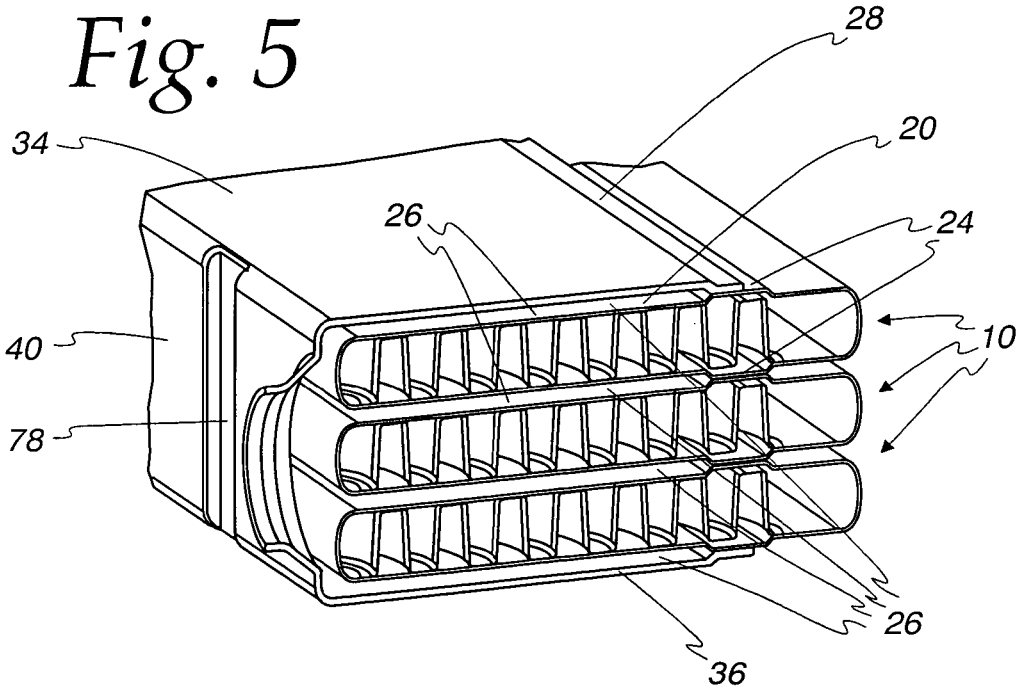
FIG. 5 is a perspective view of another assembled heat exchanger incorporating the present invention.
Figure 6:
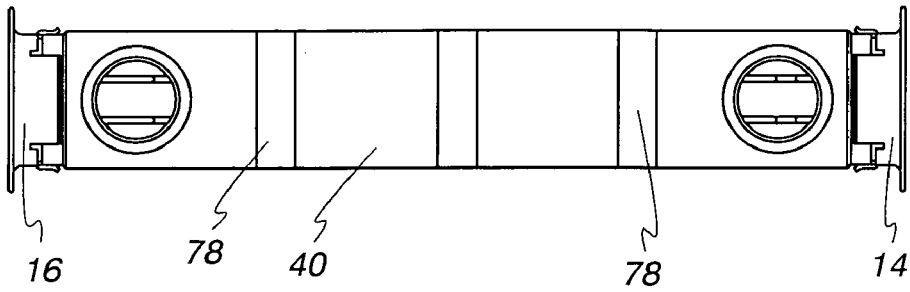
FIG. 6 is a side view of a heat exchanger in accordance with the present invention.
Figure 7:
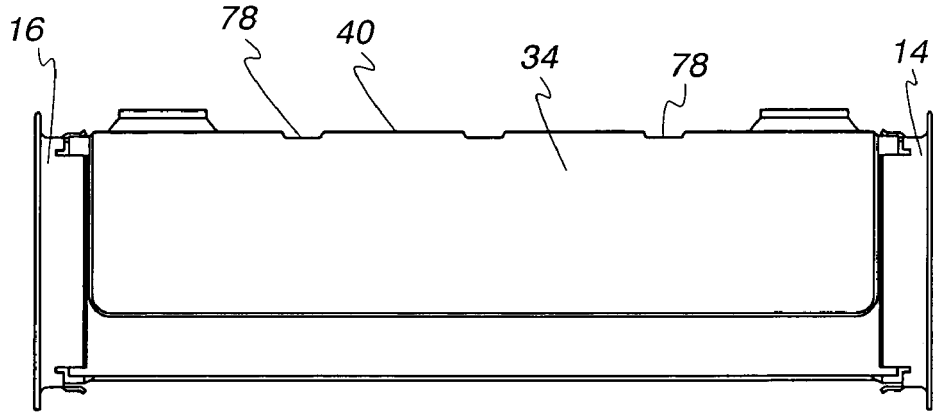
FIG. 7 is a top view of a heat exchanger in accordance with the present invention with an inlet and outlet collecting tank.
Figure 11:
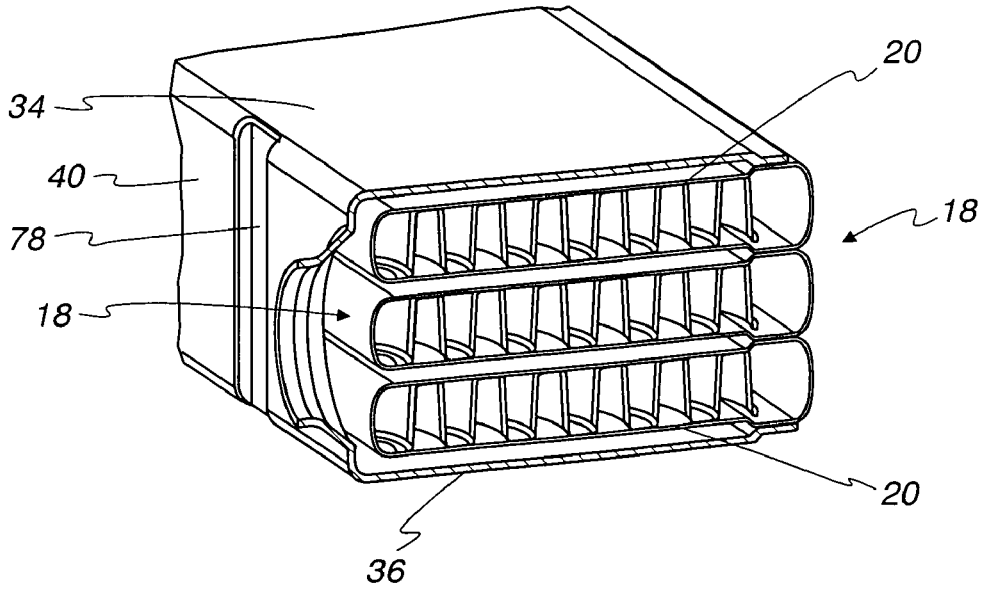
FIGS. 11-14 are perspective views showing variants of heat exchangers incorporating the present invention.

FIGS. 5 and 11 illustrate a housing 30 formed as an open profile with two flanges or arms 34, 36, enclosing only part of the total periphery of the stack of flat tubes 10, in which the enclosed part is much more than half of the total periphery. The two arms 34, 36 extend roughly parallel from a connecting base section 40 of the housing 30, with the arms 34, 36 advantageously having the same length. The channels 26 between the flat tubes 10 are closed to the open side of the housing 30 by abutting adjacent cross-sectional widenings 24 of the tubes 10.

In the illustrated embodiments, the housing arms 34, 36 advantageously extend in the direction of the wide sides 20 of the flat tubes 10 and are connected to the wide sides 20 of the outer flat tubes 10 of the stack. It should be understood, however, that it would be within the scope of the invention for the arms to extend in the direction of the narrow sides 18 of the flat tubes 10, with the connection then being made on the narrow side 18 of a flat tube 10.

The flat tubes 10 shown in FIG. 10 are included in the FIG. 5 embodiment, whereas the flat tubes 10 shown in FIG. 9 (in which the dimension of the cross-sectional widening 24 was somewhat reduced in comparison) are included in the FIG. 11 embodiment.

The housing 30 encloses only part of the periphery of the stack of flat tubes (at least more than about 50% to about 90% of the total periphery). The housing 30 in the heat exchanger of FIG. 11, for example, is generally U-shaped to enclose roughly three sides of the periphery of the stack of flat tubes 10 (i.e., the side formed from the narrow sides 18 on one side of the stack of tubes 10 and the two sides formed from the wide sides 20), with the narrow sides 18 on the other side of the stack of tubes 10 being without further covering. The FIG. 5 heat exchanger, by contrast, does not completely enclose the wide sides 20 by the two housing arms 34, 36, with the two arms 34 and 36 having an offset connection edge 28 which serves to connect of the outer flat tube 10 to the cross-sectional widening 24 of wide side 20 and also to the flat tube ends 46 (to thereby close defined upper and lower channels). Housings of these designs are advantageously simple to produce, since, roughly speaking, they can be viewed as a sheet with two parallel flanges. Moreover, the flat tubes can be inserted or installed much more simply in such a housing 30.

Figure 3:
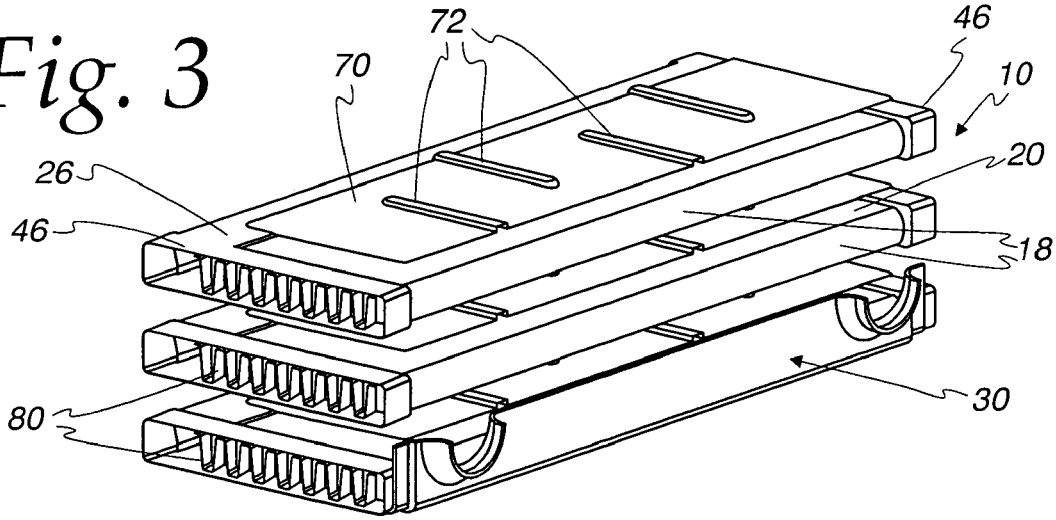
FIG. 3 is a perspective view of a separated flat tube stack according to one embodiment of the present invention.
Figure 4:
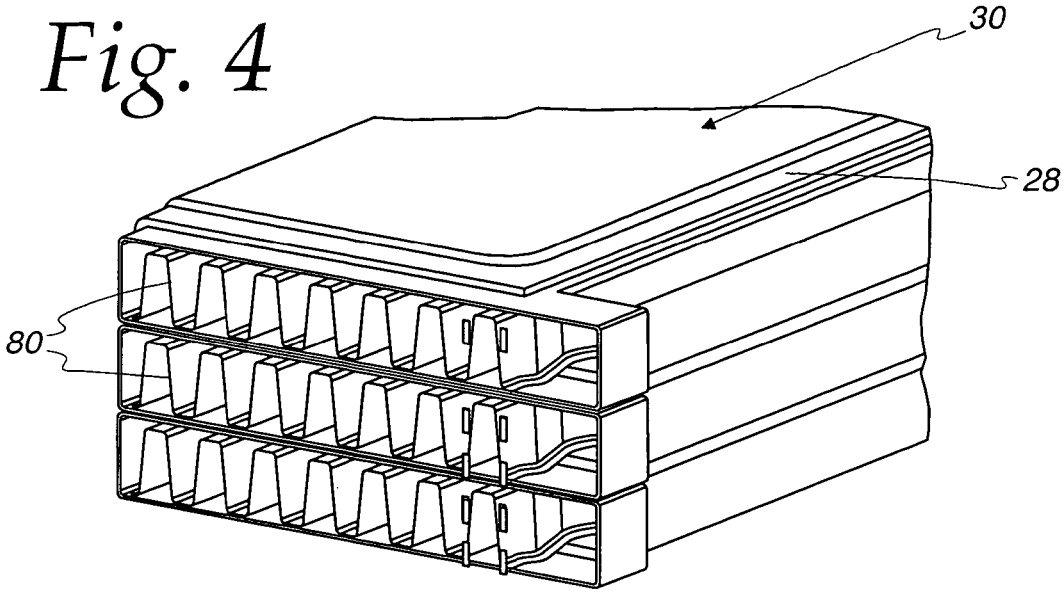
FIG. 4 is a perspective view of an assembled heat exchanger incorporating the present invention.

As clearly shown in FIGS. 3, 4 and 8, the ends 46 of the flat tubes 10 may be advantageously formed so as to bring their wide sides 20 in this region in complete contact. A tube bottom, into whose openings the tube ends discharge, is not present in the depicted practical examples. Moreover, it can be seen from these Figures that the degree of deformation of the flat tube ends 46 is quite limited so that in no special requirements are imposed on the material. The size of this end deformation corresponds to the height of the cross-sectional widening 24, which further facilitates deformation of the flat tube ends 46 because no significant elongation of the material is necessary. Moreover, with the radii between the narrow sides 18 and the wide sides 20 of flat tubes 10 made quite small in the region of the flat tube ends 46, error-free soldering and sealing in general may be readily accomplished.

Figure 15:
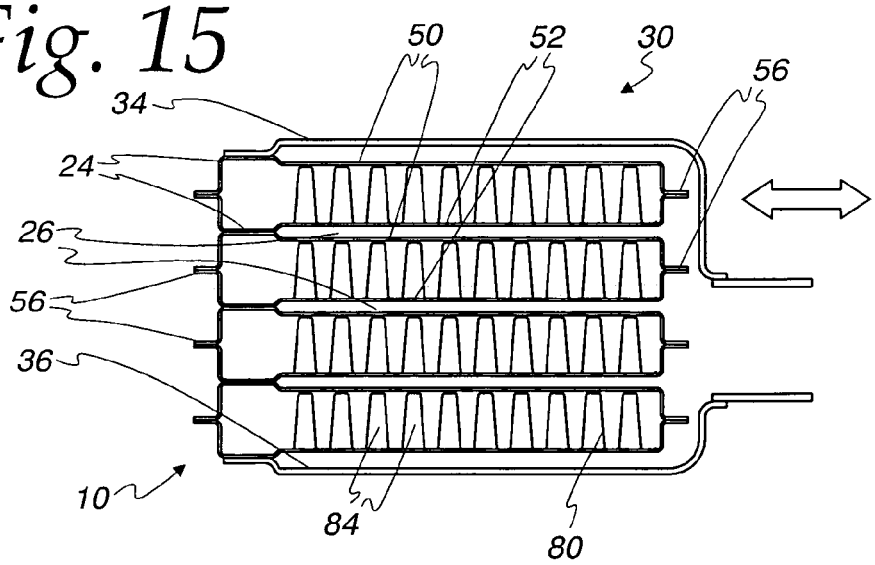
FIGS. 15 and 16 are end views of variants of heat exchangers incorporating the present invention wherein the tubes are different two-piece flat tubes.
Figure 16:
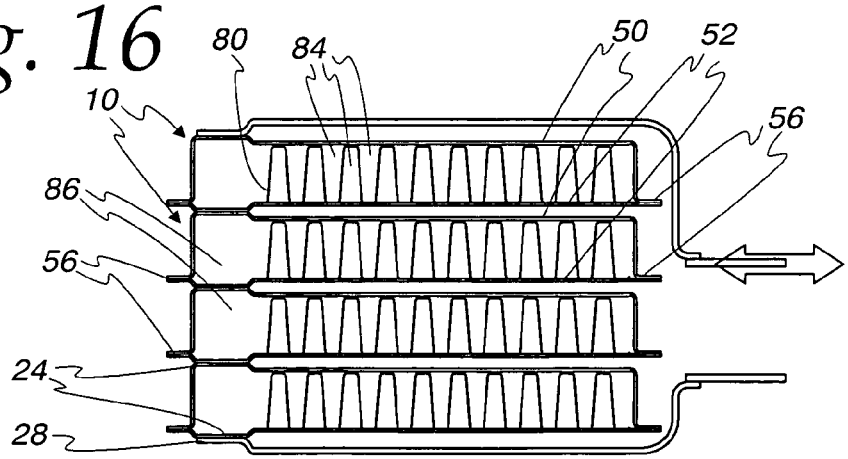
Figure 17:
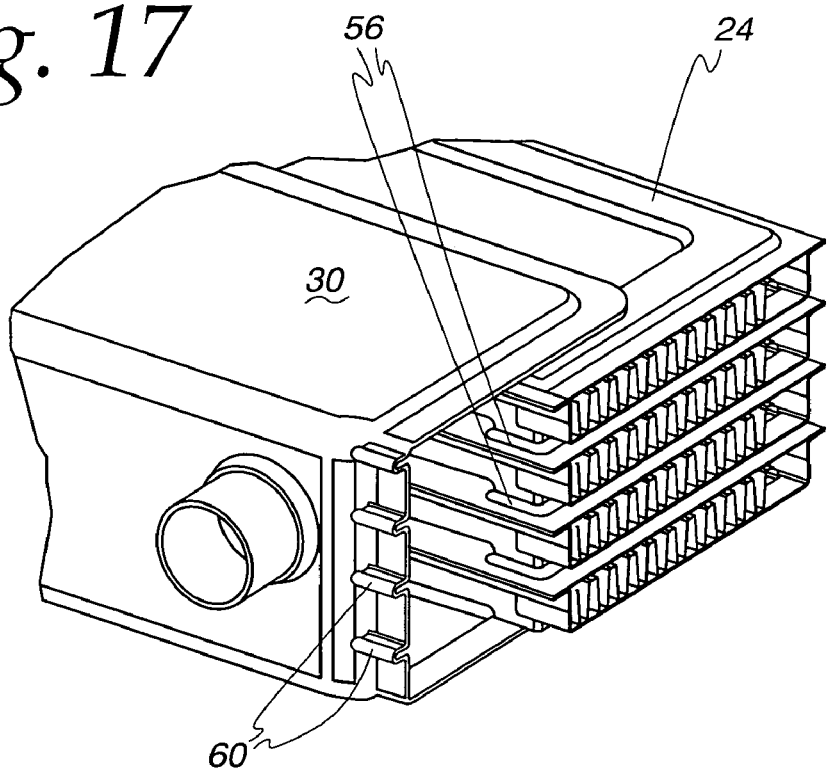
FIGS. 17-22 are perspective views of the heat exchangers of FIGS. 15 and 16, illustrating the assembly of the housing on the tube stack and the collecting tanks thereon.
Figure 18:
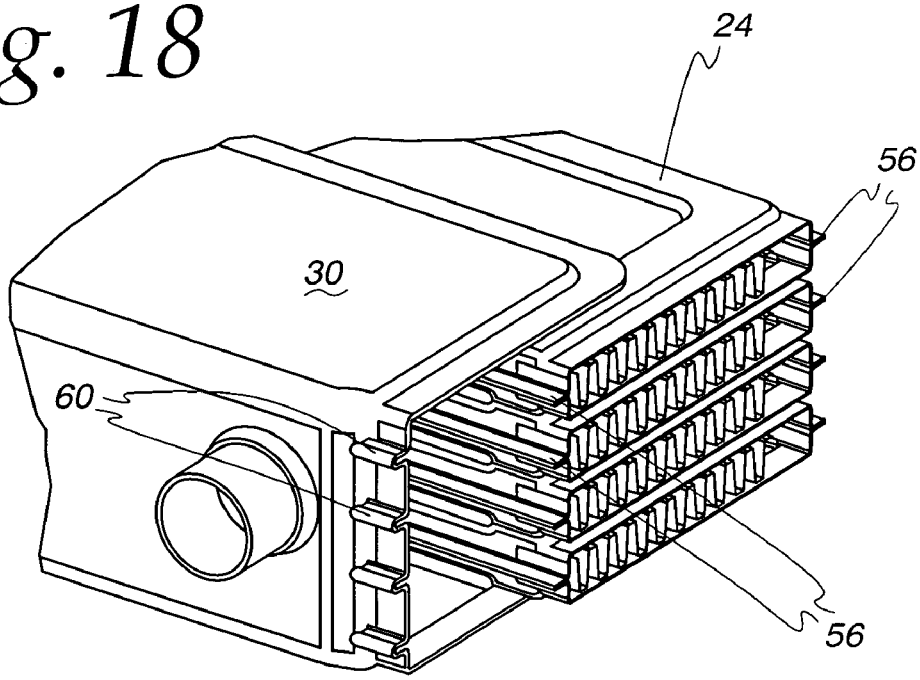
Figure 19:
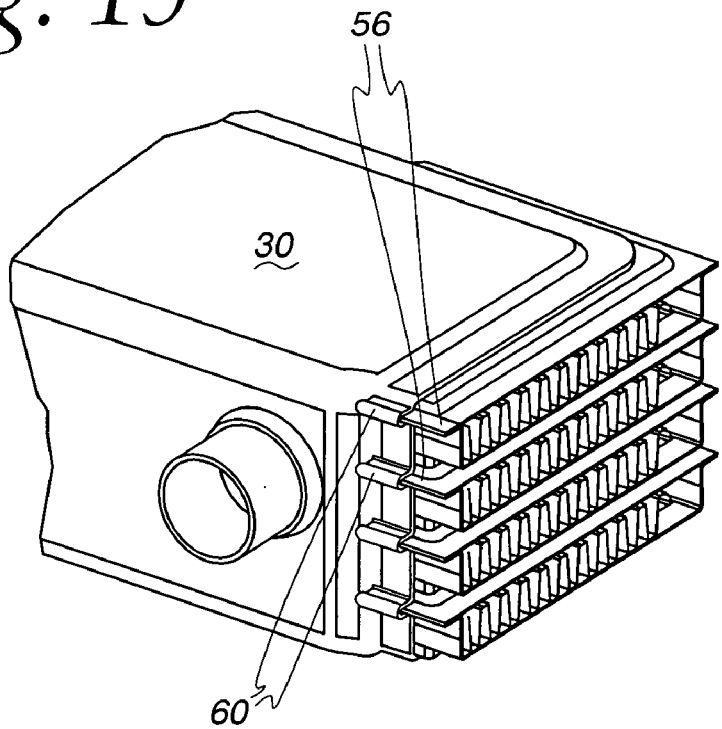
Figure 20:
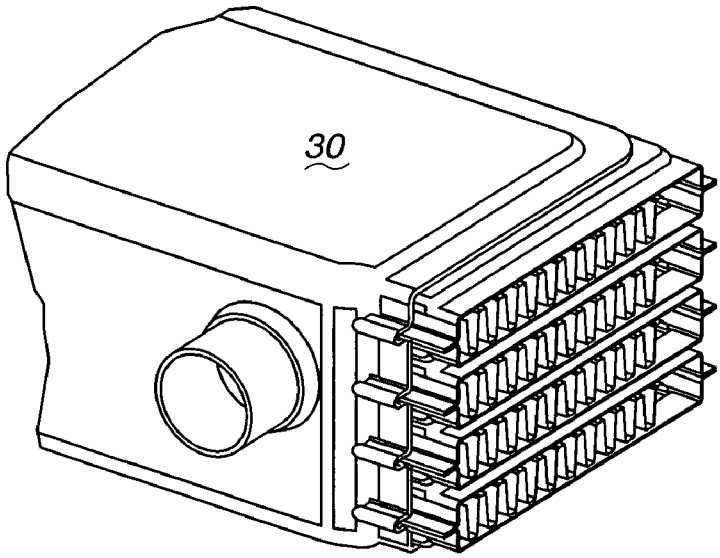
Figure 21:
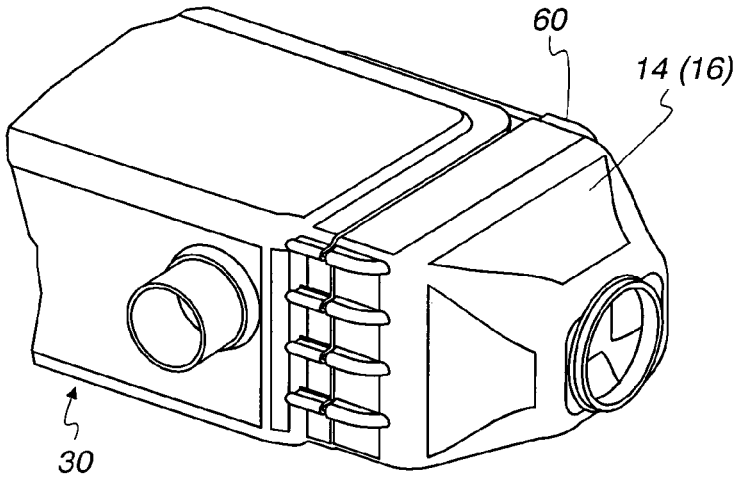
Figure 22:
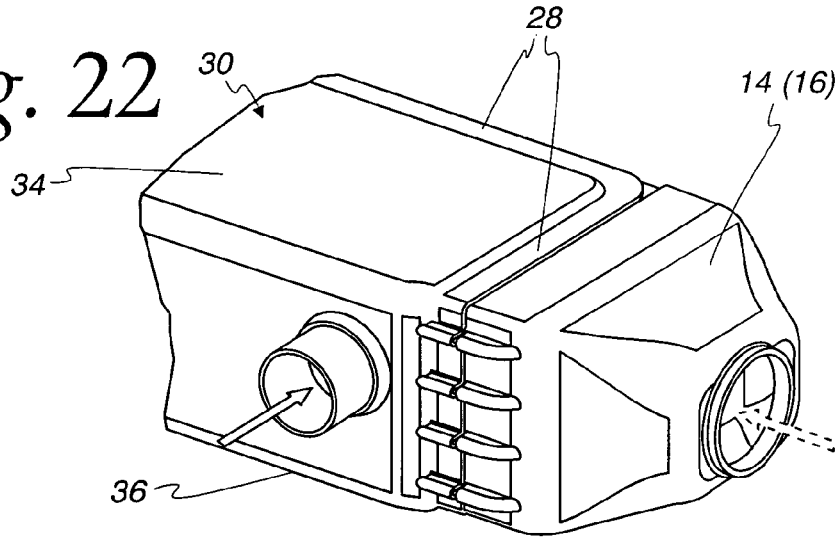

FIGS. 15-22 concern other practical examples in which the flat tubes are made of two parts. FIGS. 15 and 16 show a cross-section through two different heat exchangers in which the difference is that the flat tubes 10 in FIG. 15 are formed from two identical deformed plates 50 and 52. In FIG. 16, two differently configured plates 50 and 52 were provided to form the flat tubes 10. The two plates 50 and 52 are each assembled to form a flat tube 10 on the connection edge 56 on both sides, and the flat tubes 10 are stacked with the housing 30 is pushed over the stack. In addition, the inlet collecting tank 14 and outlet collecting tank 16 are mounted on the opposite ends of the stack, as is apparent in FIGS. 17-22.

FIGS. 17-22 refer to the tubes explained FIGS. 15 and 16. In the example according to FIGS. 15, 18, 20 and 22, the connection edge 56 is situated on the middle longitudinal plane of the flat tube 10 parallel to wide sides 20, whereas in the example according to FIGS. 16, 17, 19 and 21, the connection edge 56 runs outside of the middle longitudinal plane (i.e., in the plane of plate 52 which is only slightly deformed at the cross-sectional widening 24).

The collecting tanks 14, 16 and the housing 30 have receiving beads 60 in their connection edges, the geometry of which is such that each receiving bead 60 can enclose the corresponding section of the connection edge 56 so that a tight metal connection, especially a soldered connection, is possible there. After the heat exchanger, as described, has been assembled, it is introduced to a soldering furnace in order to make all the connections in one operation. Such connections of the collecting tanks have already been described in the European patent application EP 1 376 043 A2 of the same applicant (although, in contrast to the present case, no housing is present there). The full disclosure of EP 1 376 043 A2 is hereby fully incorporated by reference.

Figure 1:
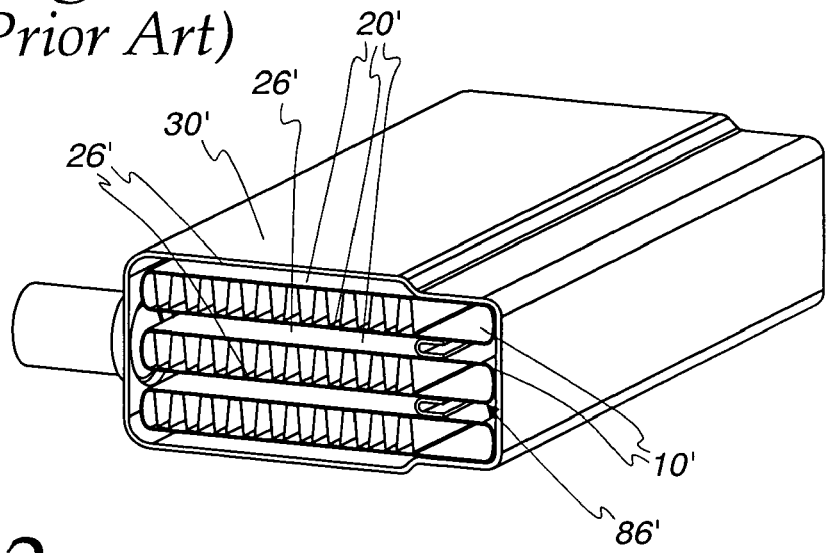
Fig. 1 (Prior Art)
FIG. 1 is a heat exchanger of a previous design which does not incorporate the present invention.
Figure 2:
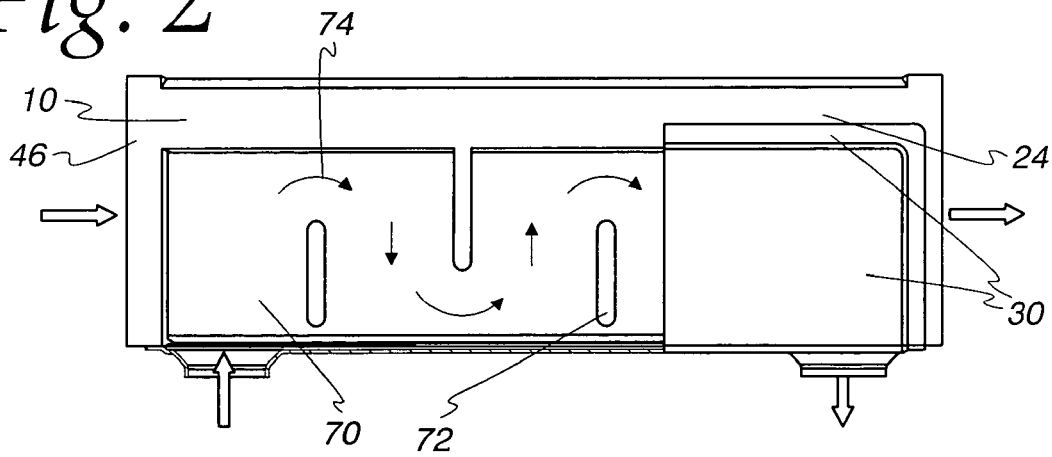
FIG. 2 is a top view of a heat exchanger incorporating the present invention.

The described basic designs, either with one-piece or two-piece flat tubes 10, permit modifications, the advantages of which lie in the area of heat exchange efficiency. This is obtained owing to the fact that meandering coolant flow paths through the channels 26 of the heat exchanger can be simply created. FIGS. 2 and 3, for example, illustrate a flat insert 70 made of very thin sheet which is inserted into the channels 26, which is provided with beads 72 for flow deflection. The arrows 74 illustrate the flow path, although it should be understood that the indicated flow path is merely an example for illustration, and is not intended to establish a specific flow principle, for example, counter-current or co-current.

Figure 12:
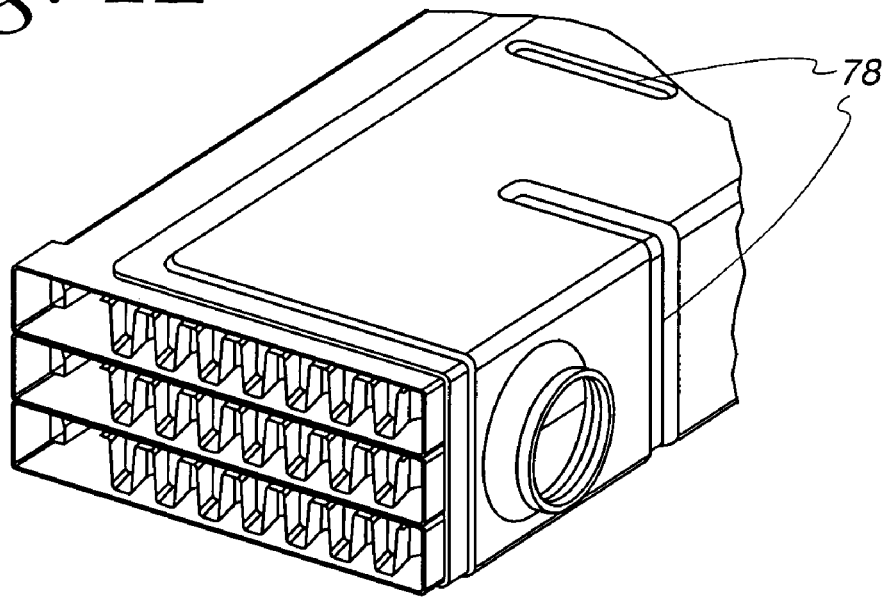
Figure 13:
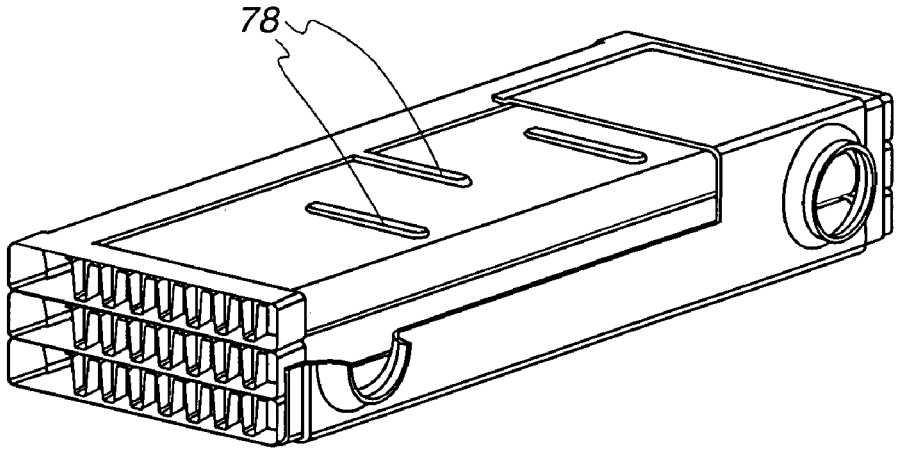

As an alternative, or in addition, it is also possible to form beads 78 in the housing 30, which serves the same purpose as shown, for example, in FIG. 12. Some beads 78 influence flow in the outer channel 26, whereas other beads 72 influence flow in the channels 26 between flat tubes 10. Inserts 70 such as shown may advantageously be provided in particular with one-piece welded flat tubes 10. The same effect can also be advantageously and easily provided by the targeted deformation of the wide sides 20 of two-piece flat tubes 10 (which two-piece flat tubes 10 may be advantageously formed by soldering).

Corrugated internal inserts 80 with preferably discrete flow passages 84 for exhaust are illustrated in the flat tubes 10 of all practical examples. The internal inserts 80 extend in the longitudinal direction of flat tubes 10 roughly over their entire length. A usually smaller part of the total cross-section of flat tubes 10 in cross-section may advantageously remain to create an exhaust bypass 86 and, if provided, may advantageously be located in the region of cross-sectional widening 24 of the flat tubes 10. This is advantageous since the bypass 86, in which no cooling of the exhaust is desired, can be very simply isolated, ensuring that the flow passage 84 of the internal insert 80 lying on bypass 86 is not traversed by exhaust. This bypass may be accomplished by a partition in the collecting tank (not shown), having a foot that closes off the passage such as is known to those skilled in the art. One suitable such structure is disclosed in European Patent Appl. No. EP 04 019 339.3 (corresponding to U.S. Ser. No. 11/201, 783, filed Aug. 11, 2005), the disclosures of which are hereby fully incorporated by reference.

It should also be understood that the present invention could also be used with heat exchangers in which such inserts and/or bypasses are not present in the tubes. For example, during use of utility vehicles no exhaust bypass has yet been provided, because utility vehicles are ordinarily operated with only limited interruptions (i.e., long-term operation). A bypass 86 makes sense if operation is connected with continuous operation, which is often the case, for example, in passenger cars.

Figure 14:
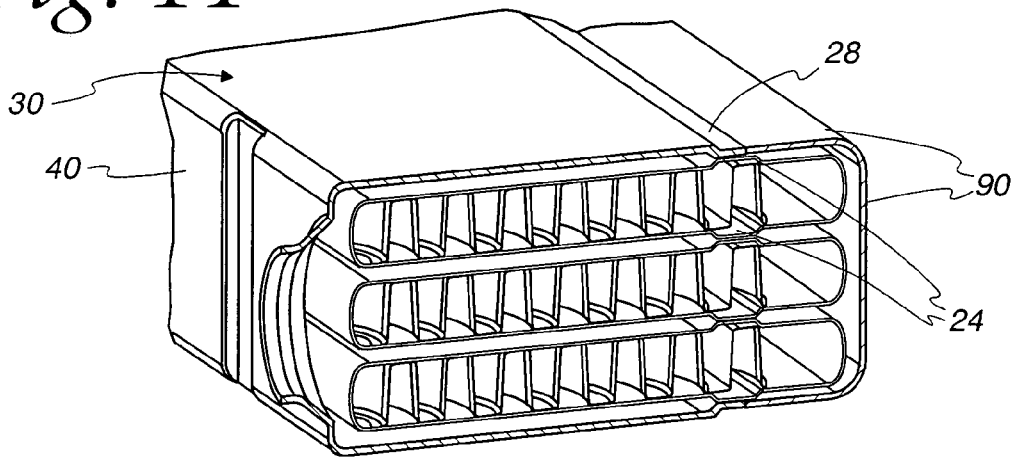

Another feature which may be used in some applications incorporating the present invention is illustrated in FIG. 14, where a cover cap 90 is adjacent to the connection edge 28 of the housing 30 and fastened to the cross-sectional widening 24 with its connection edge. This configuration might be preferred when the strips of the cross-sectional widening 24 are to lie somewhat further in the direction of the center of the flat tube than was shown in FIG. 10.

The depicted and described practical examples show heat exchangers with only one stack of flat tubes 10 consisting of three or four flat tubes 10. As already explained above, the number of flat tubes 10 per stack is adapted according to the purpose. Moreover, heat exchangers incorporating the present invention may also include several stacks of flat tubes 10.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A heat exchanger, comprising:

a stack of flat tubes for gas, said tubes having wide and narrow sides and being spaced to form channels therebetween for flow of a coolant;

a housing for said stack of flat tubes, said housing enclosing only part of the periphery of said stack of flat tubes; and means for maintaining said flat tubes in a spaced condition, said means at least partially formed along the periphery not enclosed by said housing and defining an inner space of at least one tube of said flat tubes, said inner space having an interior, said interior being inside a region bounded by said wide side and said narrow side of said at least one tube, said means additionally closing said channels along the tube stack periphery not enclosed by said housing such that gas traveling through the inner space contacts the portion of the means formed along the periphery not enclosed by the housing.

2. The heat exchanger of claim 1, wherein the housing is spaced on all sides relative to the periphery of the tube stack to define a channel between the inside of the housing and the stack.

3. The heat exchanger of claim 1, wherein said housing is U-shaped with arms extending in the direction of the wide sides of the flat tubes, and said housing arms are joined to the wide sides of the outermost flat tubes.

4. The heat exchanger of claim 1, further comprising a cross-sectional widening extending in the longitudinal direction of the flat tubes, wherein said housing is U-shaped with arms connected to the wide sides of the flat tubes.

5. The heat exchanger of claim 4, wherein the cross-sectional widening is provided in at least one of the wide sides of the flat tubes and extends in a strip over the entire length of flat tubes.

6. The heat exchanger of claim 4, wherein the housing arms have an offset connection edge connected to the cross-sectional widening.

7. The heat exchanger of claim 6, wherein said housing connection edge has beads receiving the corresponding section of connection edges of the tubes.

8. The heat exchanger of claim 4, wherein said flat tubes are stacked with their cross-sectional widening abutting each other.

9. The heat exchanger of claim 8, wherein said tubes are formed of plates and the channels are formed by deformation of the plates.

10. The heat exchanger of claim 8, wherein said tubes are formed of one piece with a welded longitudinal seam in one of the two narrow sides, and the cross-sectional widening is made from a sheet strip during flat tube production.

11. The heat exchanger of claim 1, further comprising receiving beads on two sides of the connection edge of the collecting tanks.

12. The heat exchanger of claim 1, further comprising internal inserts in said flat tubes.

13. The heat exchanger of claim 12, wherein said internal insert is a corrugated sheet in which corrugations form discrete flow passages for the gas.

14. The heat exchanger of claim 1, further comprising an inlet collecting tank and an outlet collecting tank for the gas.

15. The heat exchanger of claim 14, further comprising a bypass within the flat tubes defined by the internal inserts and a partition in at least one of the inlet and outlet collecting tanks.

16. The heat exchanger of claim 15, wherein at least the flow passage of the internal insert adjacent to the bypass is essentially not traversed by gas so that heat transfer to said bypass is suppressed.

* * * * *

UNITED STATES PATENT AND TRADEMARK OFFICE

CERTIFICATE OF CORRECTION

PATENT NO. : 7,631,688 B2
APPLICATION NO. : 11/272204
DATED : December 15, 2009
INVENTOR(S) : Brost et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 589 days.

Signed and Sealed this

Second Day of November, 2010

David J. Kappos

David J. Kappos
*Director of the United States Patent and Trademark Office*